US012808006B2

(12) United States Patent
Yamashita et al.

(10) Patent No.: US 12,808,006 B2
(45) Date of Patent: Nov. 24, 2026

(54) COLD-WORKABLE MECHANICAL STRUCTURAL STEEL, AND METHOD FOR MANUFACTURING SAME

(71) Applicant: Kobe Steel, Ltd., Kobe (JP)

(72) Inventors: Koji Yamashita, Kobe (JP); Yuta Inoue, Kobe (JP); Masayuki Sakata, Kobe (JP); Takuya Kochi, Kobe (JP); Yosuke Matsumoto, Kobe (JP); Tatsunori Uchida, Kobe (JP)

(73) Assignee: Kobe Steel, Ltd., Kobe (JP)

( * ) Notice: Subject to any disclaimer, the term of this patent is extended or adjusted under 35 U.S.C. 154(b) by 548 days.

(21) Appl. No.: 18/546,718

(22) PCT Filed: Feb. 2, 2022

(86) PCT No.: PCT/JP2022/004045
§ 371 (c)(1),
(2) Date: Aug. 16, 2023

(87) PCT Pub. No.: WO2022/181272
PCT Pub. Date: Sep. 1, 2022

(65) Prior Publication Data

US 2024/0150861 A1 May 9, 2024

(30) Foreign Application Priority Data

Feb. 26, 2021 (JP) ..... 2021-030472
Dec. 23, 2021 (JP) ..... 2021-209428

(51) Int. Cl.

| | |
|---|---|
| ***C21D 8/00*** | (2006.01) |
| ***C21D 1/18*** | (2006.01) |
| ***C21D 1/32*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |

(52) U.S. Cl.
CPC ..... *C21D 8/00* (2013.01); *C21D 1/18* (2013.01); *C21D 1/32* (2013.01); *C21D 6/004* (2013.01); *C21D 6/005* (2013.01); *C21D 6/008* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C21D 2211/002* (2013.01); *C21D 2211/005* (2013.01); *C21D 2211/008* (2013.01); *C21D 2211/009* (2013.01)

(58) Field of Classification Search
None
See application file for complete search history.

(56) References Cited

FOREIGN PATENT DOCUMENTS

| | | | | |
|---|---|---|---|---|
| CA | 3 126 378 | C | | 5/2023 |
| JP | 2001-89830 | A | | 4/2001 |
| JP | 2001089830 | A | * | 4/2001 |
| JP | 2020-125538 | A | | 8/2020 |

OTHER PUBLICATIONS

International Search Report & Written Opinion issued Mar. 29, 2022 in PCT/JP2022/004045 , filed on Feb. 2, 2022, 10 pages (with English Translation).
International Preliminary Report on Patentability and Written Opinion issued Sep. 7, 2023, in PCT/JP2022/004045 (with English Translation), 10 Pages.

* cited by examiner

*Primary Examiner* — Anthony M Liang
(74) *Attorney, Agent, or Firm* — Oblon, McClelland, Maier & Neustadt, L.L.P.

(57) ABSTRACT

A cold-workable mechanical structural steel may include: C: 0.30 to 0.45 mass %; Si: 0.10 to 0.40 mass %; Mn: 0.50 to 1.00 mass %; P: 0.050 mass % or less; S: 0.050 mass % or less; Cr: 0.80 to 1.30 mass %; Al: 0.01 to 0.10 mass %; and a balance of iron and inevitable impurity, the steel having an area percentage of pro-eutectoid ferrite of 10% or larger and 70% or smaller; containing at least one selected from the group consisting of bainite, martensite, and pearlite; and having a dislocation density of $3.5\times10^{14}$ $m^{-2}$ or larger.

20 Claims, 1 Drawing Sheet

COLD-WORKABLE MECHANICAL STRUCTURAL STEEL, AND METHOD FOR MANUFACTURING SAME

CROSS-REFERENCE TO RELATED APPLICATIONS

The present application is the national stage of international application PCT/JP2022/004045, filed on Feb. 2, 2022, and claims the benefit of the filing date of Japanese Appl. No. 2021-209428, filed on Dec. 23, 2021, and Japanese Appl. No. 2021-030472, filed on Feb. 26, 2021.

TECHNICAL FIELD

The present disclosure relates to a cold-workable mechanical structural steel, and a method for manufacturing the same.

BACKGROUND ART

Manufacture of various parts such as automotive parts and construction machine parts often employs spheroidizing annealing, for the purpose of enhancing cold workability of a hot-rolled material such as carbon steel or alloy steel. The rolled material whose cold workability was improved by spheroidizing annealing is cold worked, optionally followed by mechanical working such as cutting, and is then formed into a predetermined shape, quenched-and-tempered, to finally adjust the strength.

Conditions of the spheroidizing annealing have been reviewed in recent years from the viewpoint of energy saving, particularly emphasizing shortening of the operation time of spheroidizing annealing. A shortened operation time of spheroidizing annealing, if successfully achieved, will accordingly reduce energy consumption and $CO_2$ emission.

The previously-known, hot-rolled material obtained after a considerably shortened operation time for spheroidizing annealing (may be referred to as a "spheroidizing annealing time", hereinafter) has, however, been known to degrade the spheroidization degree, which is an index of the degree of spheroidization of cementite, to become difficult to be fully softened, and to degrade the cold workability, thus making it difficult to shorten the spheroidizing annealing time. Techniques have therefore been examined to fully soften the steel even gone through a shortened spheroidizing annealing time.

For example, Patent Document 1 discloses a technique of adjusting, in a rolled material having predetermined components, the area percentage of pro-eutectoid ferrite to 30% or larger and 70% or smaller, and the average crystal grain size of ferrite crystal grain to 5 to 15 μm, thereby providing a mechanical structural steel that successfully keeps the cold workability even gone through a shortened spheroidizing annealing time.

CONVENTIONAL ART DOCUMENT

Patent Document

Patent Document 1: JP 2020-125538 A

SUMMARY OF THE INVENTION

Problems to be Solved by the Invention

Use of the mechanical structural steel described in Patent Document 1 has shortened the spheroidizing annealing time (total of holding time at predetermined holding temperature, and cooling time from the holding temperature down to a predetermined air cooling start temperature), up to approximately 10 hours, in contrast to the previous process which takes approximately 15 hours. There is, however, stronger demand for shortened spheroidizing time than ever before, which cannot be satisfied even with use of the mechanical structural steel described in Patent Document 1.

Considering the situation, the present invention is to provide a cold-workable mechanical structural steel, which can be sufficiently softened even at a relatively low spheroidizing annealing temperature for example at approximately 750° C., and even for a duration for example shorter than 10 hours, which is obviously shorter than before, and a method for manufacturing the same.

Solution to the Problems

A first aspect of the present invention relates to a cold-workable mechanical structural steel that includes:

C: 0.30 to 0.45 mass %;
Si: 0.10 to 0.40 mass %;
Mn: 0.50 to 1.00 mass %;
P: 0.050 mass % or less;
S: 0.050 mass % or less;
Cr: 0.80 to 1.30 mass %;
Al: 0.01 to 0.10 mass %; and
the balance: iron and inevitable impurity, the steel having an area percentage of pro-eutectoid ferrite of 10% or larger and 70% or smaller; containing at least one selected from the group consisting of bainite, martensite, and pearlite; and having a dislocation density of $3.5\times10^{14}$ $m^{-2}$ or larger.

A second aspect of the present invention relates to the cold-workable mechanical structural steel according to the first aspect, wherein the pro-eutectoid ferrite has an average crystal grain size of 6 μm or smaller.

A third aspect of the present invention relates to the cold-workable mechanical structural steel according to the first or second aspect, further containing at least one selected from the group consisting of:

Cu: 0.25 mass % or less (exclusive of 0 mass %);
Ni: 0.25 mass % or less (exclusive of 0 mass %); and
Mo: 0.40 mass % or less (exclusive of 0 mass %).

A fourth aspect of the present invention relates to the cold-workable mechanical structural steel according to any one of the first to third aspects, further containing at least one selected from the group consisting of:

Ti: 0.20 mass % or less (exclusive of 0 mass %);
Nb: 0.20 mass % or less (exclusive of 0 mass %); and
V: 1.50 mass % or less (exclusive of 0 mass %);

A fifth aspect of the present invention relates to the cold-workable mechanical structural steel according to any one of the first to fourth aspects, further containing at least one selected from the group consisting of:

N: 0.01 mass % or less (exclusive of 0 mass %);
Mg: 0.02 mass % or less (exclusive of 0 mass %);
Ca: 0.05 mass % or less (exclusive of 0 mass %);
Li: 0.02 mass % or less (exclusive of 0 mass %); and
REM: 0.05 mass % or less (exclusive of 0 mass %).

A sixth aspect of the present invention relates to a method for manufacturing the cold-workable mechanical structural steel described in any one of the first to fifth aspects, the method includes subjecting the steel to:

(a) hot-working at a working temperature T0 of over 800° C. and 1000° C. or below, at a compression ratio of 20% or larger;

(b) subsequent to (a), cooling down to a first cooling temperature T1 of 670° C. or above and 730° C. or below, at a first cooling rate CR1 of 5° C./sec or faster;

(c) subsequent to (b), holding at the first cooling temperature T1 for a holding time t1 of 10 to 600 seconds; and (d) subsequent to (c), cooling down to a second cooling temperature T2 of 550° C. or below, at a second cooling rate CR2 of 5° C./sec or faster.

A seventh aspect of the present invention relates to a method for manufacturing a steel wire, the method includes subjecting the cold-workable mechanical structural steel manufactured by the method described in the sixth aspect, to at least one process of annealing, spheroidizing annealing, drawing, heading, or quenching-and-tempering.

Effects of the Invention

One embodiment of the present invention makes it possible to provide a cold-workable mechanical structural steel, which can be sufficiently softened even at a relatively low spheroidizing annealing temperature, and even for a duration obviously shorter than before; and a method for manufacturing the same.

DETAILED DESCRIPTION

Figure 1:
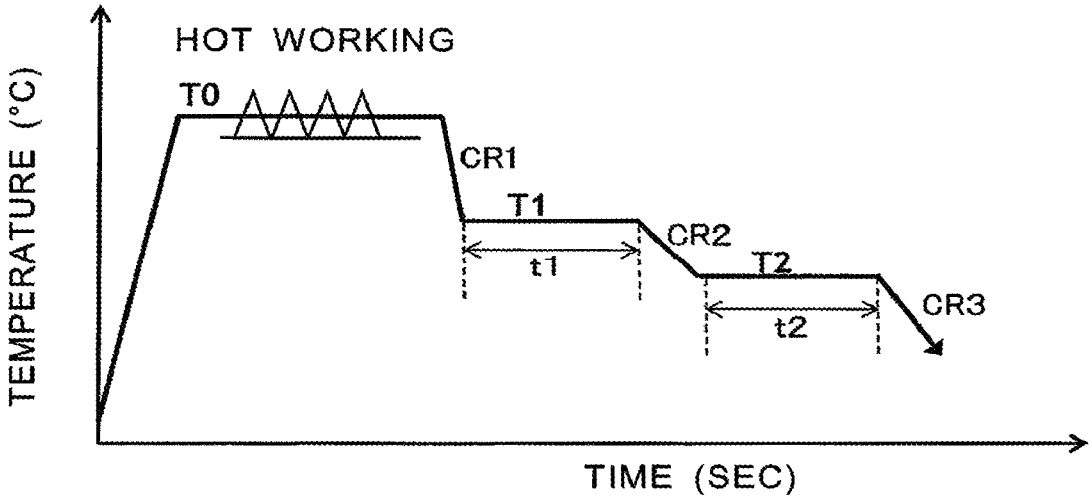
FIG. 1 is a schematic drawing illustrating a thermomechanical treatment pattern (thermomechanical heating history) of a steel material, in a method for manufacturing a cold-workable mechanical structural steel according to the present invention.

The present inventors went through investigations from every aspect. The present inventors then found that a cold-workable mechanical structural steel, which can be sufficiently softened even at a relatively low spheroidizing annealing temperature, and even for an obviously shortened duration, is obtainable, typically by controlling the cold-workable mechanical structural steel with predetermined components, so as to have the area percentage of pro-eutectoid ferrite appropriately adjusted to 10% or larger and 70% or smaller, so that the portion other than the pro-eutectoid ferrite contains one or more selected from the group consisting of bainite, martensite, and pearlite; and so as to have a dislocation density of $3.5\times10^{14}$ $m^{-2}$ or larger.

The present inventor also found that such cold-workable mechanical structural steel is manufacturable by subjecting the steel having a predetermined chemical composition to: (a) hot-working at a working temperature T0 of over 800° C. and 1000° C. or below, at a compression ratio of 20% or larger; (b) subsequent to (a), cooling down to a first cooling temperature T1 of 670° C. or above and 730° C. or below, at a first cooling rate CR1 of 5° C./sec or faster; (c) subsequent to (b), holding at the first cooling temperature T1 for a holding time t1 of 10 to 600 seconds; and (d) subsequent to (c), cooling down to a second cooling temperature T2 of 550° C. or below, at a second cooling rate CR2 of 5° C./sec or faster.

Embodiments of the present invention will be detailed below.

Note that the term "wire rod" in this specification will be used to denote a rolled wire rod, which is a wire-formed steel material having undergone hot rolling, and subsequent cooling down to room temperature. The term "steel wire" will denote a wire-formed steel material, which is obtained by subjecting the wire rod to typically annealing or the like to adjust characteristic thereof.

<1. Chemical Composition>

The cold-workable mechanical structural steel according to an embodiment of the present invention contains C: 0.30 to 0.45 mass %, Si: 0.10 to 0.40 mass %, Mn: 0.50 to 1.00 mass %, P: 0.050% mass % or less, S: 0.050 mass % or less, Cr: 0.80 to 1.30 mass %, and Al: 0.01 to 0.10 mass %.

The individual elements will be detailed below.

(C: 0.30 to 0.45 mass %)

C is a strengthening element, whose content less than 0.30 mass % will fail in achieving a required level of strength of the final product. On the other hand, the content exceeding 0.45 mass % will degrade the cold workability and toughness of the steel. Hence, the C content is determined in the range from 0.30 to 0.45 mass %. The C content is preferably 0.43 mass % or less, and more preferably 0.40 mass % or less. This is because the pro-eutectoid ferrite may be precipitated in larger quantities.

(Si: 0.10 to 0.40 mass %)

Si is useful as a deoxidizing element, and as a strengthening element that is contained for the purpose of increasing the strength of the final product by solid solution hardening. Aiming at effectively demonstrating the effect, the Si content is controlled to 0.10 mass % or more. On the other hand, an excessive Si content will excessively increase the hardness, thereby degrading the cold workability of the steel. Hence, the Si content is controlled to 0.40 mass % or less.

(Mn: 0.50 to 1.00 mass %)

Mn is an element effective for increasing the hardenability, thereby increasing the strength of the final product. Aiming at effectively demonstrating the effect, the Mn content is controlled to 0.50 mass % or more. On the other hand, an excessive Mn content will increase the hardness, thereby degrading the cold workability of the steel. Hence, the Mn content is controlled to 1.00 mass % or less.

(P: 0.050 mass % or less)

P is an element inevitably contained in the steel, causes grain boundary segregation in the steel, thereby degrading the ductility of the steel. Hence, the P content is controlled to 0.050 mass % or less.

(S: 0.050 mass % or less)

S is an element inevitably contained in the steel, existing in a form of MnS in the steel, will degrade the ductility of the steel, thereby adversely degrading the cold-workability. Hence, the S content is controlled to 0.050 mass % or less.

(Cr: 0.80 mass % or more, 1.30 mass % or less)

Cr is an element effective for increasing the hardenability of the steel material, thereby increasing the strength of the final product. Aiming at effectively demonstrating the effect, the Cr content is controlled to 0.80 mass % or more. Such effect increases as the Cr content increases. An excessive Cr content will, however, excessively increase the strength, thereby degrading the cold workability of the steel, so that the Cr content is controlled to 1.30 mass % or less.

(Al: 0.01 mass % or more, 0.10 mass % or less)

Al is an element that is useful as a deoxidizing agent, and can bind with N to precipitate AlN, thereby preventing abnormal growth of crystal grains and decrease in the strength during working. Aiming at effectively demonstrating the effect, the Al content is controlled to 0.01 mass % or more, which is preferably 0.015 mass % or more, and more preferably 0.020 mass % or more. An excessive Al content will, however, excessively produce $Al_2O_3$ to degrade the cold forgeability. Hence, the Al content is controlled to 0.10 mass % or less, preferably 0.090 mass % or less, and more preferably 0.080 mass % or less.

The basic components are as described above. In one preferred embodiment, the balance is iron and inevitable impurity. The inevitable impurity whose contamination is acceptable include elements (for example, B, As, Sn, Sb, Ca, O, H, etc.) possibly entrained due to circumstances such as ingredient, material, or manufacturing facility.

Note that, there are some elements, such as P and S, whose contents are the lesser the better, and are thus usually considered to be the inevitable impurities, but whose compositional ranges are particularly specified as described above. Hence, in the context of this specification, the term "inevitable impurity" that composes the balance is understood to exclude such elements whose compositional ranges are separately specified.

(Other Optional Elements)

Another preferred embodiment of the present invention may optionally contain any additional element other than those described above, without degrading the operation of the embodiment of the present invention. Such optional element will be exemplified below. Property of the steel may further be improved, depending on the component to be contained.

Note, the notation "exclusive of 0 mass %" for the other optional element means that such elements are intentionally added, but excluding the amount (trace amount) inevitably contained as the impurity.

(One or more selected from the group consisting of Cu: 0.25 mass % or less (exclusive of 0 mass %), Ni: 0.25 mass % or less (exclusive of 0 mass %), and Mo: 0.40 mass % or less (exclusive of 0 mass %))

Cu: 0.25 mass % or less (exclusive of 0 mass %), Ni: 0.25 mass % or less (exclusive of 0 mass %)

Cu and Ni are elements that effectively improve the hardenability, and act to increase the product strength. Such action increases as the content of these elements increases, wherein each of the Cu and Ni contents is preferably 0.05 mass % or more for effective exhibition of the effect, which is more preferably 0.08 mass % or more, and even more preferably 0.10 mass % or more. An excessive content will, however, excessively produce a supercooled structure to excessively increase the strength, thereby degrading the cold forgeability. Hence, each of the Cu and Ni contents is preferably 0.25 mass % or less. The content is more preferably 0.22 mass % or less, and even more preferably 0.20 mass % or less. Cu and Ni may be contained independently, or both may be contained together. The contents of Cu and Ni, when contained together, may be freely selectable within the individual ranges described above.

Mo: 0.40 mass % or less (exclusive of 0 mass %)

Mo is an element effectively increasing the hardenability of the steel material, and thereby increasing the strength of the final product, so that Mo may be intentionally added to be contained therein. Such effect increases as the Mo content increases. An excessive Mo content will, however, excessively increase the strength, thereby degrading the cold workability of the steel. In particular, co-existence of Mo and Cr in the steel would distinctively make the steel less likely to be softened after the spheroidizing annealing. Hence, the Mo content is controlled to 0.40 mass % or less.

(One or more selected from the group consisting of Ti: 0.20 mass % or less (exclusive of 0 mass %); Nb: 0.20 mass % or less (exclusive of 0 mass %); and V: 1.50 mass % or less (exclusive of 0 mass %))

Ti, Nb, and V are elements that combine with N to form a compound (nitride), thereby reducing the amount of solid-solubilized N in the steel, from which an effect of reducing the deformation resistance is obtainable. Aiming at effectively demonstrating the effect, each of the Ti, Nb, and V contents is preferably controlled to 0.05 mass % or more, more preferably 0.06 mass % or more, and even more preferably 0.08 mass % or more. Excessive contents of these elements will, however, increase the nitride contents to increase the deformation resistance, thereby degrading the cold forgeability. Hence, each of the Ti and Nb contents is preferably 0.20 mass % or less, more preferably 0.18 mass % or less, and even more preferably 0.15 mass % or less; and the V content is preferably 1.50 mass % or less, more preferably 1.30 mass % or less, and even more preferably 1.00 mass % or less. Ti, Nb, and V may be contained independently, or two or more thereof may be contained with the individual contents controlled as desired, individually within the aforementioned ranges.

(One or more selected from the group consisting of N: 0.01 mass % or less (exclusive of 0 mass %), Mg: 0.02 mass % or less (exclusive of 0 mass %), Ca: 0.05 mass % or less (exclusive of 0 mass %), Li: 0.02 mass % (exclusive of 0 mass %), and REM (rare earth metal): 0.05 mass % or less (exclusive of 0 mass %))

N is an impurity inevitably contained in the steel, and, when solid-solubilized N is contained in the steel, will increase the hardness and decrease the ductility due to strain aging, thereby degrading the cold-forgeability. Hence, the N content is preferably 0.01 mass % or less, more preferably 0.009 mass % or less, and even more preferably 0.008 mass % or less. Mg, Ca, Li, and REM are elements effective for spheroidizing sulfide compound-based inclusions such as MnS, and for improving the deformability of the steel. Such action increases as the contents of these elements increase, wherein each of the Mg, Ca, Li and REM contents is preferably 0.0001 mass % or more for effective exhibition of the effect, which is more preferably 0.0005 mass % or more. Excessive contents will, however, saturate the effect which do not worth the content, so that each of the Mg and Li contents is preferably 0.02 mass % or less, more preferably 0.018 mass % or less, and even more preferably 0.015 mass % or less. Each of the Ca and REM contents is preferably 0.05 mass % or less, more preferably 0.045 mass % or less, and even more preferably 0.040 mass % or less. N, Ca, Mg, Li and REM may be contained independently, or two or more thereof may be contained with the individual contents controlled as desired, individually within the aforementioned ranges.

The REM content means the total content of any of 17 elements that include Sc and Y (2 elements in total), and a series of elements from La to Lu (15 elements in total), and the phrase "containing REM" means that one or more elements selected from these 17 elements are contained.

<2. Metallographic Structure>

The cold-workable mechanical structural steel according to the embodiment of the present invention contains pro-eutectoid ferrite whose area percentage is 10% or larger and 70% or smaller. The pro-eutectoid ferrite contributes to soften the steel after spheroidizing annealing. The steel cannot, however, be fully softened just by containing the pro-eutectoid ferrite, after spheroidizing annealing at relatively low temperatures and for a short time.

The inventors of the present application have found that elevation of the dislocation density successfully suppressed the hardness and variation thereof, and sufficiently softened the steel, even after the spheroidizing annealing relatively at low temperatures and in a short time.

More specifically, the steel contains one or more selected from the group consisting of bainite, martensite, and pearlite, in a portion other than the pro-eutectoid ferrite (residual metallographic structure). As will be detailed later, bainite, martensite, and pearlite may have the dislocation density increased therein, when appropriately subjected to thermomechanical treatment. This successfully increases the dislocation density up to $3.5\times10^{14}$ $m^{-2}$ or above as a whole (that is, as averaged across all metallographic structures).

[2-1. Area Percentage of Pro-Eutectoid Ferrite: 10% or Larger and 70% or Smaller]

Abundant pro-eutectoid ferrite can promote aggregation and spheroidization of carbides such as cementite, and thus can reduce the hardness of the steel. From this point of view, the area percentage of pro-eutectoid ferrite needs to be 10% or larger. The area percentage of pro-eutectoid ferrite is preferably 20% or larger, more preferably 30% or larger, and even more preferably 40% or larger. On the other hand, the steel, in which the area percentage of pro-eutectoid ferrite exceeds 70%, is obtainable only after special processes including slow cooling and holding over a very long duration, so that manufacture thereof is difficult with use of ordinary mass production facilities. Hence, the area percentage of pro-eutectoid ferrite will be 70% at the maximum.

The area percentage of a certain metallographic structure, such as pro-eutectoid ferrite, may be determined by drawing a grid pattern on a metallographic photo, finding the count of intersections (grid points) that fall on the metallographic structure, and by finding a ratio of the count to the total number of intersections. Any intersection that falls on the boundary between the certain metallographic structure, such as pro-eutectoid ferrite, and some other metallographic structure will be scored 0.5 points.

The metallographic structure is observed at a midpoint between the surface and the center. That is, a wire rod is observed at a quarter position (D/4) of the diameter D, away from the surface.

[2-2. Containing One or More Selected from the Group Consisting of Bainite, Martensite, and Pearlite]

The steel contains one or more selected from the group consisting of bainite, martensite, and pearlite, besides the aforementioned pro-eutectoid ferrite.

Bainite, martensite, and pearlite may have an increased density of dislocation that is formed inside in association with transformation, if appropriately thermomechanical treated as described later. With the metallographic structure having a large dislocation density thus formed, the steel will have the dislocation density as high as of $3.5\times10^{14}$ $m^{-2}$ or above as a whole.

There may be any one of bainite, martensite, or pearlite; or two or more of them.

The amount (area percentage) of bainite, martensite, and pearlite may be adjusted as desired, as long as a dislocation density of $3.5\times10^{14}$ $m^{-2}$ or above as a whole is obtainable. The total area percentage of bainite, martensite, and pearlite (total of any of bainite, martensite and pearlite that present), relative to the entire metallographic structure excluding the aforementioned pro-eutectoid ferrite (residual metallographic structure), is preferably 50% or larger, and more preferably 70% or larger.

The entire residual metallographic structure is more preferably formed of any one or more of bainite, martensite, or pearlite. This is because a desired dislocation density may be achieved more easily. Note that the phrase "the entire residual metallographic structure is formed of any one or more of bainite, martensite, or pearlite" may encompass a case where a metallographic structure other than bainite, martensite, or pearlite was not found in the residual metallographic structure when observed in a relatively narrow field of view, but a small amount of the metallographic structure other than bainite, martensite, or pearlite was found when observed in a wider field of view.

The term "pearlite" in the context of this specification conceptionally includes not only a morphology in which a so-called lamellar structure is clearly observable, but also a so-called "fine pearlite" in which a clean lamellar structure is not observable due to fragmentation of cementite.

Perlite is preferably composed of fine perlite. This is because a desired dislocation density may be achieved more easily.

[2-3. Dislocation Density of $3.5\times10^{14}$ $m^{-2}$ or Larger]

The cold-workable mechanical structural steel according to the embodiment of the present invention has a dislocation density of $3.5\times10^{14}$ $m^{-2}$ or larger, which is preferably $5\times10^{14}$ $m^{-2}$ or larger. With the dislocation density set high, carbide will become more easily fragmented and solid-solubilized during the spheroidizing annealing. This sufficiently softens the steel while suppressing variation in the hardness, even if the spheroidizing annealing took place at a relatively low temperature for a short time.

The dislocation density is more preferably $1\times10^{16}$ $m^{-2}$ or smaller. This is because the dislocation density exceeding $1\times10^{16}$ $m^{-2}$ would make the dislocation density after spheroidizing annealing relatively high, depending on annealing condition of the spheroidizing annealing, and would elevate the hardness.

Such high dislocation density is not achievable simply as a result of presence of one or more of bainite, martensite, or pearlite, and is achievable only after appropriate thermomechanical treatment as described later, to increase the dislocation introduced in association with transformation.

The dislocation density may be determined by X-ray diffractometry, based on strain (lattice strain) obtained by the Williamson-Hall (WH) method, and a value of the Burgers vector, as detailed later in EXAMPLES.

[2-4. Pro-Eutectoid Ferrite Having Average Crystal Grain Size of 6 μm or Smaller]

The cold-workable mechanical structural steel according to the embodiment of the present invention preferably has an average crystal grain size of pro-eutectoid ferrite of 6 μm or smaller. This is because with the average crystal grain size of pro-eutectoid ferrite controlled to 6 μm or smaller, it now becomes possible to more reliably suppress variation in the hardness after the spheroidizing annealing.

<3. Manufacturing Method>

As will be detailed below, the cold-workable mechanical structural steel according to the embodiment of the present invention may be manufactured by subjecting the steel to thermomechanical treatment, in which the steel is subjected to predetermined hot working within a specific temperature range and subsequently cooled and held under predetermined conditions.

FIG. 1 is a schematic drawing illustrating a thermomechanical treatment pattern (thermomechanical heating history) of a steel material, in a method for manufacturing a cold-workable mechanical structural steel according to the present invention. In the manufacturing method illustrated in FIG. 1, a steel material such as a wire material having the aforementioned chemical components is subjected thermo-mechanical treatment that includes steps (a) to (d) below.

(a) hot-working at a working temperature T0 of over 800° C. and 1000° C. or below, at a compression ratio of 20% or larger;

(b) subsequent to (a), cooling down to a first cooling temperature T1 of 670° C. or above and 730° C. or below, at a first cooling rate CR1 of 5° C./sec or faster;

(c) subsequent to (b), holding at the first cooling temperature T1 for a holding time t1 of 10 to 600 seconds; and (d) subsequent to (c), cooling down to a second cooling temperature T2 of 550° C. or below, at a second cooling rate CR2 of 5° C./sec or faster.

The individual steps will be described below.

[Step (a): Hot-working at working temperature T0 of over 800° C. and 1000° C. or below, at a compression ratio of 20% or larger]

As shown in FIG. 1, the steel (wire rod, for example) having the aforementioned chemical composition is heated to temperature T0 (working temperature T0) to subject to hot working. The working temperature T0 is over 800° C., and 1000° C. or below. The compression ratio in the hot working is controlled to 20% or larger.

Aiming at reserving a required amount of pro-eutectoid ferrite, the working temperature T0 is controlled to 1000° C. or below, and a compression ratio in hot working is controlled to 20% or larger. The working temperature T0 controlled to 1000° C. or below, and the compression ratio in hot working controlled to 20% or larger will further give an effect of reducing the grain size of pro-eutectoid ferrite.

With the working temperature T0 if controlled to 800° C. or below, the steel will acceleratingly cause transformation at high temperatures during the subsequent cooling, and will fail in keeping the dislocation density at $3.5\times10^{14}$ $m^{-2}$ or above. The working temperature T0 is therefore controlled to over 800° C.

The hot working may be in any style, as long as the compression ratio may be controlled to 20% or larger. The hot working is exemplified by pressing and rolling.

The compression ratio is calculated as follows.

<Compression Ratio in Pressing (May Also be Referred to as Rolling Reduction, in this Case)>

$$\text{Compression ratio (\%)}=(h-h2)/h1\times100$$

h1: height of steel material before worked, h2: height of steel material after worked <Compression Ratio of Wire Rod Obtained by Rolling (May Also be Referred to as Reduction of Area, in this Case)>

$$\text{Compression ratio (\%)}=(S1-S2)/S1\times100$$

S1: cross-sectional area of steel material before worked, h2: cross-sectional area of steel material after worked The compression ratio of 20% or larger may be achieved by a single run of hot working, or may be totally achieved by several runs of hot working while maintaining the temperature T0.

[Step (b): Subsequent to (a), cooling down to a first cooling temperature T1 of 670° C. or above and 730° C. or below, at a first cooling rate CR1 of 5° C./sec or faster]

Subsequent to step (a), the steel is cooled down to the first cooling temperature T1 at a first cooling rate CR1, as illustrated in FIG. 1. The first cooling temperature T1 is 670° C. or above and 730° C. or below. The first cooling rate CR1 is 5° C./sec or faster. With the cooling down to the first cooling temperature T1 at 5° C./sec or faster, the obtainable cold-workable mechanical structural steel will have a dislocation density of $3.5\times10^{14}$ $m^{-2}$ or larger. With the first cooling rate CR1 controlled to 5° C./sec or faster, the crystal grain size of pro-eutectoid ferrite grains may be reduced.

The cooling rate may be measured by contacting a contact thermometer, such as a thermocouple, with the steel material. Another simple method may use a non-contact thermometer to measure the surface temperature of the steel material.

[Step (c): Subsequent to (b), holding at the first cooling temperature T1 for a holding time t1 of 10 to 600 seconds]

Subsequent to (b), the steel is held at the first cooling temperature T1 for the holding time t1, as illustrated in FIG. 1

The holding time t1 is 10 to 600 seconds, preferably 10 to 400 seconds, and more preferably 10 to 200 seconds. In order to achieve a pro-eutectoid ferrite content which corresponds to an area percentage of 10 to 70%, the holding time t1 at the first cooling temperature T1 is controlled to 10 seconds or longer. On the other hand, the holding time t1 exceeding 600 seconds would unfortunately lower the density of dislocation, in association with phase transformation that takes place during further cooling from the first cooling temperature T1, to lower than $3.5\times10^{14}$ $m^{-2}$. An excessively long holding time t1 would condense C and other alloying elements in austenite, which would suppress growth of ferrite possibly occurs in the subsequent cooling process, thus making it difficult to achieve a sufficient area percentage of ferrite. The holding time t1 is thus controlled to 600 seconds or shorter. The holding time t1 is preferably 400 seconds or shorter, and more preferably 200 seconds or shorter.

[Step (d): Subsequent to (c), cooling down to a second cooling temperature T2 of 550° C. or below, at a second cooling rate CR2 of 5° C./sec or faster]

Subsequent to step (c), the steel is cooled down to the second cooling temperature T2 at a second cooling rate CR2, as illustrated in FIG. 1. The second cooling temperature T2 is 550° C. or below. The second cooling rate CR2 is 5° C./sec or faster. The second cooling rate CR2 is preferably 50° C./sec or slower. In order to adjust the dislocation density of the cold-workable mechanical structural steel to $3.5\times10^{14}$ $m^{-2}$ or larger, the steel is cooled from the first cooling temperature T1 down to the temperature T2 which is 550° C. or below, at a cooling rate of 5° C./sec or faster.

The cooling subsequent to step (d), down to a temperature lower than the second cooling temperature T2, is exemplified by a case of an embodiment shown in FIG. 1 in which the steel is held at the second cooling temperature T2 for the holding time t2, and then cooled down to room temperature at a third cooling rate CR3 (for example, furnace cooling, natural cooling, or rapid cooling (typically by gas quenching)).

The cooling is, however, not limited thereto, and may rely upon any freely selectable method. An example of such cooling may assume the second cooling temperature T2 as room temperature, and may conduct the cooling from the first cooling temperature T1 down to the room temperature, at the second cooling rate CR2.

In a case of holding at the second cooling temperature T2 for the holding time t2, the second cooling temperature T2 is preferably adjusted to 400° C. to 550° C., and the holding time t2 is preferably adjusted to 100 to 3000 seconds. With the second cooling temperature T2 controlled to 400° C. or above, a desired area percentage of ferrite will be obtainable more easily. The second cooling temperature T2 is more preferably 500° C. or higher. With the second cooling temperature T2 controlled to 550° C. or below, a desired dislocation density will be obtainable more easily. The second cooling temperature T2 is more preferably 540° C. or below. With the holding time t2 controlled to 100 seconds or longer, a desired area percentage of ferrite will be obtainable more easily. The holding time t2 is preferably 150 seconds or longer, and more preferably 210 seconds or longer. With the holding time t2 controlled to 3000 seconds or shorter, it now becomes possible to achieve a high dislocation density more easily, while keeping a high productivity. The holding time t2 is more preferably 1500 seconds or shorter.

In an alternative case, the cooling down to the second cooling temperature T2 at the second cooling rate CR2 may be followed, without interposed by holding (that is, the with a holding time t2 of 0 seconds), by cooling from the second cooling temperature T2 down to room temperature at a third cooling rate CR3 different from the second cooling rate CR2. The third cooling rate CR3 in this case may be faster or slower than the second cooling rate CR2. The third cooling rate CR3 is obtainable by a method exemplified by furnace cooling, natural cooling or rapid cooling (gas quenching, for example). The second cooling rate CR2 and the third cooling rate CR3 in this case are preferably 1 to 25° C./sec. With the second cooling rate CR2 and the third cooling rate CR3 controlled to 1° C./sec or faster, a high dislocation density is obtainable more easily, meanwhile with the second cooling rate CR2 and the third cooling rate CR3 controlled to 25° C./sec or slower, a desired area percentage of ferrite is obtainable more easily.

The cold-workable mechanical structural steel according to the embodiment of the present invention is thus obtainable by the aforementioned method of manufacturing.

The cold-workable mechanical structural steel according to the embodiment of the present invention, although presumed to be subjected to spheroidizing annealing, may occasionally be subjected to other working (wire drawing, for example), prior to or subsequent to the spheroidizing annealing.

The cold-workable mechanical structural steel according to the embodiment of the present invention may be sufficiently softened even at a relatively low spheroidizing annealing temperature, for example at 750° C., and even for a duration (total of the holding time at a predetermined holding temperature, and a cooling time from the holding temperature down to a predetermined air cooling start temperature) which is considerably shortened compared to before (approximately 11 hours in Patent Document 1) to approximately 5 hours or shorter, as will be described later in EXAMPLES. The present invention can also manufacture a steel wire, by subjecting the steel material obtained under the aforementioned manufacturing conditions (cold-workable mechanical structural steel), to one or more processes of annealing, spheroidizing annealing, wire drawing, heading, and quenching-and-tempering. The steel wire in this context not only refers to a wire-like steel material obtained by subjecting the steel material manufactured under the aforementioned conditions typically to annealing, spheroidizing annealing, wire drawing, heading, or quenching-and-tempering, to control the characteristic, but also encompasses any wire-like steel material having gone through a usual step, other than the aforementioned annealing and so forth, given by a secondary product manufacturer.

Having described the method for manufacturing the cold-workable mechanical structural steel according to the embodiment of the present invention, a skilled person in the art, who understands a desired characteristic of the cold-workable mechanical structural steel according to the embodiment of the present invention, would arrive after trial and error at a method, but other than the aforementioned method, for manufacturing a cold-workable mechanical structural steel having a desired characteristic according to the embodiment of the present invention.

EXAMPLES

Embodiments of the present invention will be described more specifically below, referring to Examples. The present invention is by no means restricted by Examples below, instead allowing implementation with appropriate modifications within the scope conforming to the aforementioned and later-described spirit, wherein all of such modifications fall within the scope of the present invention.

TABLE 1

| | Chemical component (mass %) Balance is Fe and inevitable impurity | | | | | | | | | |
|---|---|---|---|---|---|---|---|---|---|---|
| | C | Si | Mn | P | S | Cu | Ni | Cr | Mo | AI |
| Steel type 1 | 0.35 | 0.19 | 0.67 | 0.010 | 0.006 | 0.01 | 0.02 | 0.95 | 0.17 | 0.036 |
| Steel type 2 | 0.40 | 0.20 | 0.70 | 0.013 | 0.006 | 0.03 | 0.03 | 0.98 | 0.16 | 0.025 |
| Steel type 3 | 0.42 | 0.18 | 0.79 | 0.019 | 0.009 | 0.01 | 0.01 | 1.05 | 0.01 | 0.034 |

A test piece of φ 8 mm×12 mm for processing Formaster (Thermec Master-Z) test was manufactured for each of rolled materials made of Steel type 1 (SCM435), Steel type 2 (SCM440), and Steel type 3 (SCR440) shown in Table 1. SCM435, SCM440, and SCR440 are steel types specified in Japanese Industrial Standards JIS G4053.

As summarized in Table 1, Steel type 1 and Steel type 2 contain Cu and Ni at an impurity level. That is, Cu and Ni are inevitable impurities not intentionally added. Steel type 3 contains 0.01 mass % of Mo at an impurity level. That is, Mo in Steel type 3 is an inevitable impurity not intentionally added.

The thus manufactured test pieces for the processing Formaster test were subjected to thermomechanical treatment illustrated in FIG. 1 with use of a Formaster equipment, to manufacture samples of cold-workable mechanical structural steel.

The test pieces were heated to the working temperature T0 at a heating rate of 10° C./sec, held for 300 seconds after the arrival at the working temperature T0, and then hot-worked by pressing twice. Each test piece was pressed for the first time at a strain rate of 50/sec to reduce the height thereof from 12 mm to 7 mm (ε=0.54), and after 5 seconds, pressed for the second time at a strain rate of 50/sec to reduce the height from 7 mm to 3 mm (ε=0.85).

Table 2 summarizes the working temperature T0, the first cooling temperature T1, the first cooling rate CR1, the holding time t1, the second cooling temperature T2, and the second cooling rate CR2. For reference, also the holding time t2 and the third cooling rate CR3 are included in Table 2.

Samples Nos. 1-3 and 1-4 are samples that were cooled from the first cooling temperature T1 down to room temperature which corresponds to the second cooling temperature T2, at the second cooling rate CR2. Samples Nos. 1-5, 2-2, and 3-4 are samples that were hot-worked at a working temperature T0, and then cooled down to room temperature at 30° C./sec.

The cases that fall outside the conditions described in the manufacturing method according to the embodiment of the present invention were underlined.

TABLE 2

| Sample No. | Steel type | | T0 (° C.) | CR1 (° C./sec) | T1 (° C.) | t1 (sec) | T2 (° C.) | CR2 (° C./sec) | t2 (sec) | CR3 (° C./sec) |
|---|---|---|---|---|---|---|---|---|---|---|
| 1-1 | Steel type 1 | Example | 900 | 30 | 700 | 20 | 500 | 30 | 200 | 10 |
| 1-2 | Steel type 1 | Example | 900 | 30 | 700 | 100 | 500 | 30 | 200 | 10 |
| 1-3 | Steel type 1 | Example | 900 | 30 | 700 | 100 | Room temp. | 10 | — | — |
| 1-4 | Steel type 1 | Comparative Example | 1100 | 30 | 660 | 1000 | Room temp. | 10 | — | — |
| 1-5 | Steel type 1 | Comparative Example | 900 | 30 | Room temp. | — | — | — | — | — |
| 1-6 | Steel type 1 | Comparative Example | 1050 | 30 | 745 | 200 | 500 | 0.1 | 1 | 30 |
| 2-1 | Steel type 2 | Example | 900 | 30 | 700 | 150 | 540 | 30 | 2000 | 10 |
| 2-2 | Steel type 2 | Comparative Example | 900 | 30 | Room temp. | — | — | — | — | — |
| 3-1 | Steel type 3 | Example | 900 | 30 | 700 | 150 | 550 | 30 | 250 | 10 |
| 3-2 | Steel type 3 | Example | 900 | 30 | 700 | 150 | 530 | 30 | 1000 | 10 |
| 3-3 | Steel type 3 | Example | 900 | 30 | 700 | 500 | 550 | 30 | 200 | 10 |
| 3-4 | Steel type 3 | Comparative Example | 900 | 30 | Room temp. | — | — | — | — | — |

Each sample after the thermomechanical treatment was cut along the center axis into equal quarters, to obtain four samples having longitudinal cross sections. One of the samples was reserved as a sample not subjected to spheroidizing annealing (may occasionally referred to as pre-spheroidizing annealing sample), and one other sample was subjected to spheroidizing annealing (may occasionally referred to as spheroidized-annealed sample). Each sample was housed in a vacuum sealed tube for the spheroidizing annealing.

Figure 2:
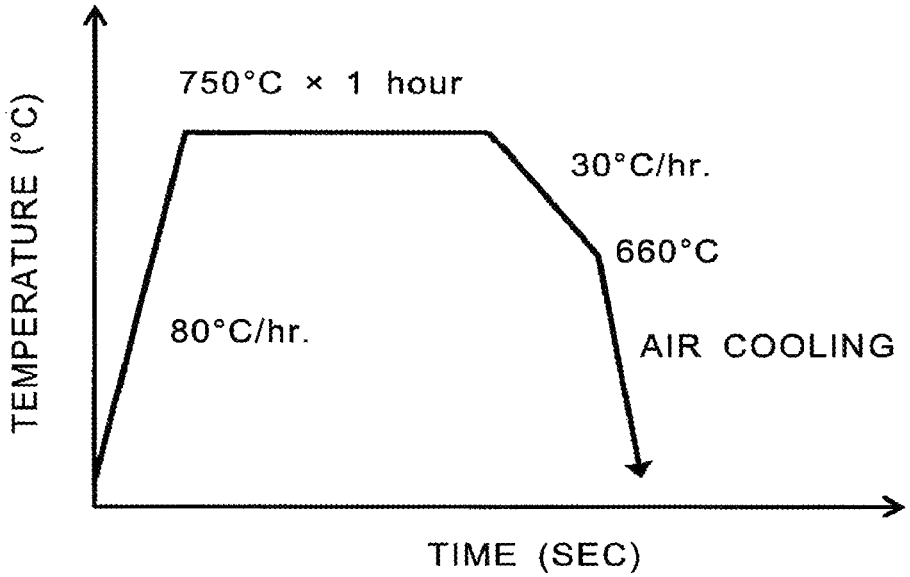
FIG. 2 is a schematic drawing illustrating spheroidizing annealing conditions (SA1).

FIG. 2 is a schematic drawing illustrating spheroidizing annealing conditions (SA1).

The spheroidizing annealing followed a scheme of heating up to 750° C. at 80° C./hour, holding for 1 hour, cooling down to 660° C. at a cooling rate of 30° C./hour, and allowing to cool.

That is, the spheroidizing annealing temperature is as relatively low as 750° C., and the spheroidizing annealing time is as remarkably short as approximately 4.7 hours. Also the holding time is significantly as short as 1 hour.

Each pre-spheroidizing annealing sample was embedded in a resin for the convenience of observation of the longitudinal cross section, and then subjected to (1) measurement of area percentage of pro-eutectoid ferrite, and observation of any structure other than pro-eutectoid ferrite, (2) measurement of average crystal grain size of pro-eutectoid ferrite, and (3) measurement of dislocation density.

Also each spheroidized-annealed sample was embedded in a resin for the convenience of observation of the longitudinal cross section in the same way as described above, and then subjected to (4) measurement of hardness after spheroidizing annealing, and variation thereof.

All measurements and observations in (1) to (4) were made at a D/4 position from the surface towards the center axis, where D represents the diameter of the sample.

(1) Measurement of Area Percentage of Pro-Eutectoid Ferrite

The longitudinal cross section of each pre-spheroidizing annealing sample was etched with Nital to expose the structure, and the D/4 position was photographed under an optical microscope at a 400× magnification (field of view: 220 μm wide×165 μm long). A grid pattern having 15 vertical lines at equal intervals and 10 horizontal lines at equal intervals was drawn on the thus obtained photograph, the count of intersections that fall on pro-eutectoid ferrite, out of 150 intersection points, was found, and the count was divided by 150, to determine the area percentage (%) of pro-eutectoid ferrite.

Any intersection that fell on the boundary between the pro-eutectoid ferrite and some other structure was scored 0.5 points.

To what phase does the portion other than pro-eutectoid ferrite (residual metallographic structure) belong was also identified by metallographic observation.

(2) Measurement of Average Crystal Grain Size of Pro-Eutectoid Ferrite

The longitudinal cross section of each pre-spheroidizing annealing sample was etched with Nital to expose the structure, and the D/4 position was photographed under an optical microscope at a 400× magnification (field of view: 220 μm wide×165 μm long), or at a 1000× magnification (field of view: 147 μm wide×110 μm long). Grain size (circle equivalent diameter) was obtained for the individual pro-eutectoid ferrite grains in the field of view with use of image analysis software (Image-Pro Plus ver7.0), and the average value thereof was determined as the average crystal grain size of pro-eutectoid ferrite.

Any pro-eutectoid ferrite grains cut off by the sides of the photograph (pro-eutectoid ferrite grains whose intrinsic grain size is not measurable) were excluded from the counting.

(3) Measurement of Dislocation Density

Each pre-spheroidizing annealing sample was electrolytically polished to prepare a sample for measurement of dislocation density. The sample was analyzed by X-ray diffractometry with use of a horizontal X-ray diffractometer SmartLab from Rigaku Corporation.

X-ray diffraction profile was measured by the θ/2θ diffraction method with use of a Co metal target, within the 20 range from 40° to 130°.

The obtained diffraction profile was used for determining strain, by the Williamson-Hall (WH) method. The equation below was used for the WH method.

$$\beta \cos \theta/\lambda = 0.9/D + 2\varepsilon \sin \theta/\lambda \quad \text{(Equation 1)}$$

$$\beta^2 = \beta_m^2 - \beta_s^2 \quad \text{(Equation 2)}$$

Where, β represents the true half width (rad), θ represents the Bragg angle (rad), λ represents the wavelength of incident X-ray (nm) ($\lambda$=0.1789 nm in this case), D represents the crystallite size (nm), and E represents the lattice strain.

Diffraction line broadening ascribable to a device constant was corrected by using an approximate expression (Equation 2). $\beta_m$ represents a measured half width, and $\beta_s$ represents a half width of a strain-free sample (device function). The strain-free sample used here was Si640d from NIST.

More specifically, the diffraction peaks attributable to the (110), (211), and (220) planes of pro-eutectoid ferrite ($\alpha$-Fe) in the sample were measured, to determine the diffraction angle $2\theta$ and the half width $\beta_m$.

Measured results of the individual crystal planes were then plotted, with $\sin\theta/\lambda$ on the abscissa and $\beta\cos\theta/\lambda$ on the ordinate.

A linear function (y=ax+b) was fitted to the plots to create an approximate curve. Strain ($\varepsilon$) and crystallite size (D) are known respectively from the slope and the intercept of the straight line. The strain ($\varepsilon$) was thus determined.

Dislocation density p may be expressed as (Equation 3), with use of the strain c and the Burgers vector b.

$$\rho=14.4\varepsilon^2/b^2 \quad \text{(Equation 3)}$$

Now, the Burgers vector b was sized to be $0.25\times10^{-9}$ m.

The dislocation density p was thus estimated.

(4) Hardness after Spheroidizing Annealing, and Variation Thereof

In order to confirm the effect of softening by spheroidizing annealing, the hardness of the spheroidized-annealed sample was measured on the longitudinal cross section at five D/4 positions (5 points) under a 1 kgf load, with use of a Vickers hardness tester. An average value (HV) was defined as the hardness (HV) of the sample, and a standard deviation was estimated from the measured values, which was defined as the variation of hardness (HV). Samples composed of Steel type 1 (SCM435) was judged to be sufficiently softened, with a hardness of 165 HV or smaller, and a variation of hardness of 7.0 HV or smaller. On the other hand, samples composed of Steel type 2 (SCM440) and Steel type 3 (SCR440) both containing more C were judged to be sufficiently softened, with a hardness of 180 HV or smaller, and a variation of hardness of 7.0 HV or smaller.

The area percentage of pro-eutectoid ferrite, the structure other than pro-eutectoid ferrite, the measured average crystal grain size of pro-eutectoid ferrite, the dislocation density, the hardness after spheroidizing annealing, and the variation of hardness, obtained by the aforementioned methods, were summarized in Table 3.

In Table 3, the cases that falls outside the conditions described in the embodiment of the present invention, and the cases that falls outside the evaluation criteria for softening, were underlined.

In addition, the notation "mainly" for the structures other than pro-eutectoid ferrite means that metallographic structure other than such one kind of the subject metallographic structure was not observed in the observed field of view (220 μm wide×165 μm long), (but not excluding any possible cases where a small amount of other metallographic structure is observed in a wider field of view).

Pearlite observed in the structure other than the pro-eutectoid ferrite in Sample No. 2-1 was fine pearlite.

TABLE 3

| Sample No. | | Area percentage of pro-eutectoid ferrite (%) | Structure other than pro-eutectoid ferrite | Average crystal grain size of pro-eutectoid ferrite (μm) | Dislocation density ($m^{-2}$) | Hardness (HV) | Variation of hardness (HV) |
|---|---|---|---|---|---|---|---|
| 1-1 | Example | 34 | Bainite + martensite | 4.4 | $1.09\times10^{15}$ | 160 | 6.0 |
| 1-2 | Example | 56 | Pearlite + bainite + martensite | 4.3 | $1.19\times10^{15}$ | 154 | 5.9 |
| 1-3 | Example | 31 | Mainly martensite | 5.1 | $9.03\times10^{15}$ | 157 | 3.5 |
| 1-4 | Comparative Example | 34 | Mainly pearlite | 6.1 | $3.13\times10^{14}$ | 172 | 9.1 |
| 1-5 | Comparative Example | 0 | Mainly martensite | — | $1.85\times10^{16}$ | 168 | 5.7 |
| 1-6 | Comparative Example | 49 | Mainly pearlite | 9.3 | $7.62\times10^{13}$ | 152 | 10.8 |
| 2-1 | Example | 27 | Pearlite + martensite | 5.2 | $1.90\times10^{15}$ | 171 | 4.7 |
| 2-2 | Comparative Example | 0 | Mainly martensite | — | $2.63\times10^{16}$ | 199 | 5.1 |
| 3-1 | Example | 45 | Pearlite + martensite | 4.1 | $4.90\times10^{14}$ | 158 | 3.6 |
| 3-2 | Example | 23 | Pearlite + martensite | 3.7 | $4.23\times10^{14}$ | 161 | 3.2 |
| 3-3 | Example | 17 | Pearlite + martensite | 3.1 | $9.60\times10^{14}$ | 180 | 4.8 |
| 3-4 | Comparative Example | 0 | Mainly martensite | — | $2.69\times10^{16}$ | 192 | 6.3 |

Discussion will be given below on the basis of Table 2 and Table 3.

Sample Nos. 1-1, 1-2, 1-3, 2-1, and 3-1 to 3-3 are exemplary cases that satisfy all of the requirements specified in the embodiment of the present invention. These samples were found to excel both in hardness and variation thereof, and to be sufficiently softened, even after the spheroidizing annealing at a relatively low temperature of 750° C. for a considerably short duration (holding time: 1 hour, spheroidizing annealing time: approximately 4.7 hours).

On the other hand, Sample Nos. 1-4, 1-5, 1-6, 2-2, and 3-4 are exemplary cases that do not satisfy one or more of the requirements specified in the present invention, and were found to be poor in at least either the hardness or the variation thereof after the spheroidizing annealing, that is, found to be softened only insufficiently.

Sample No. 1-4 went through an excessively high working temperature T0, an excessively low first cooling temperature T1, and an excessively long holding time t1. This made the dislocation density excessively small. This also degraded the hardness and the variation thereof after the spheroidizing annealing.

Sample No. 1-5 was held at room temperature which was excessively low as the first cooling temperature T1, and was therefore unsuccessfully held for the holding time t1 at an appropriate first cooling temperature T1 (670° C. to 730° C.). This failed in sufficiently obtaining the pro-eutectoid ferrite. This also degraded the hardness after the spheroidizing annealing.

Sample No. 1-6 went through an excessively high working temperature T0, an excessively high first cooling temperature T1, and an excessively slow second cooling rate CR2. This made the dislocation density excessively small.

The hardness value after the spheroidizing annealing was found to be good due to a sufficient amount of pro-eutectoid ferrite, but the variation in hardness was found to be poor due to small dislocation density.

Sample No. 2-2 was held at room temperature which was excessively low as the first cooling temperature T1, and was therefore unsuccessfully held for the holding time t1 at an appropriate first cooling temperature T1 (670° C. to 730° C.). This failed in sufficiently obtaining the pro-eutectoid ferrite. This also degraded the hardness after the spheroidizing annealing.

Sample No. 3-4 was held at room temperature which was excessively low as the first cooling temperature T1, and was therefore unsuccessfully held for the holding time t1 at an appropriate first cooling temperature T1 (670° C. to 730° C.). This failed in sufficiently obtaining the pro-eutectoid ferrite. This also degraded the hardness after the spheroidizing annealing.

The cold-workable mechanical structural steel of the present invention is suitable as a material for various components manufactured by cold working such as cold forging, cold heading, or cold rolling. The form of the steel may be, but not restrictively, exemplified by rolled materials such as wire and rod.

The components typically include automobile component and construction machine component, which specifically include bolt, screw, nut, socket, ball joint, inner tube, torsion bar, clutch case, cage, housing, hub, cover, case, bearing metal, tappet, saddle, bulg, inner case, clutch, sleeve, outer race, sprocket, stator, anvil, spider, rocker arm, body, flange, drum, joint, connector, pulley, fitting, yoke, ferrule, valve lifter, spark plug, pinion gear, steering shaft, and common rail. The cold-workable mechanical structural steel according to the present invention is industrially useful as a mechanical structural steel suitably applicable to a material for the aforementioned components, and can demonstrate small deformation resistance and excellent cold-workability, when processed into the various components at room temperature or in deformation heating range, after spheroidizing annealing This application claims priority based on Japanese Patent Application No. 2021-30472 filed on Feb. 26, 2021, and Japanese Patent Application No. 2021-209428 filed on Dec. 23, 2021. Japanese Patent Application Nos. 2021-30472 and 2021-209428 are incorporated herein by reference.

The invention claimed is:

1. A cold-workable mechanical structural steel, comprising:

Fe;

C in a range of from 0.30 to 0.45 mass %;

Si in a range of from 0.10 to 0.40 mass %;

Mn in a range of from 0.50 to 1.00 mass %;

P in 0.050 mass % or less;

S in 0.050 mass % or less;

Cr in a range of from 0.80 to 1.30 mass %;

Al in a range of from 0.01 to 0.10 mass %; and inevitable impurity, wherein the steel has an area percentage of pro-eutectoid ferrite in a range of from 31 to 70%, wherein the steel comprises bainite, martensite, and/or pearlite, and wherein the steel has a dislocation density of $3.5\times10^{14}$ $m^{-2}$ or larger.

2. The steel of claim 1, wherein the pro-eutectoid ferrite has an average crystal grain size of 6 μm or smaller.

3. The steel of claim 1, further comprising:

(A) Cu in a range of from greater than 0 to 0.25 mass %, Ni in a range of from greater than 0 to 0.25 mass %, and/or Mo in a range of from greater than 0 to 0.40 mass %;

(B) Ti in a range of from greater than 0 to 0.20 mass %, Nb in a range of from greater than 0 to 0.20 mass %, and/or V in a range of from greater than 0 to 1.50 mass %; and/or (C) N in a range of from greater than 0 to 0.01 mass %, Mg in a range of from greater than 0 to 0.02 mass %, Ca in a range of from greater than 0 to 0.05 mass %, Li in a range of from greater than 0 to 0.02 mass %, and/or REM in a range of from greater than 0 to 0.05 mass %.

4. A method for manufacturing the cold-workable mechanical structural steel of claim 1, the method comprising subjecting the steel to:

(a) hot-working at a working temperature T0 of over 800° C. and 1000° C. or below, at a compression ratio of 20% or larger;

(b) subsequent to the hot-working (a), cooling down to a first cooling temperature T1 of 670° C. or above and 730° C. or below, at a first cooling rate CR1 of 5° C./sec or faster;

(c) subsequent to the cooling (b), holding at the first cooling temperature T1 for a holding time t1 of 10 to 600 seconds; and (d) subsequent to the holding (c), cooling down to a second cooling temperature T2 of 550° C. or below, at a second cooling rate CR2 of 5° C./sec or faster.

5. A method for manufacturing a steel wire, comprising:

carrying out the method of claim 4; and subjecting the cold-workable mechanical structural steel obtained, to at least one process of annealing, spheroidizing annealing, wire drawing, heading, or quenching-and-tempering.

6. A method for manufacturing the cold-workable mechanical structural steel of claim 3, the method comprising subjecting the steel to:

(a) hot-working at a working temperature T0 of over 800° C. and 1000° C. or below, at a compression ratio of 20% or larger;

(b) subsequent to the hot-working (a), cooling down to a first cooling temperature T1 of 670° C. or above and 730° C. or below, at a first cooling rate CR1 of 5° C./sec or faster;

(c) subsequent to the cooling (b), holding at the first cooling temperature T1 for a holding time t1 of 10 to 600 seconds; and (d) subsequent to the holding (c), cooling down to a second cooling temperature T2 of 550° C. or below, at a second cooling rate CR2 of 5° C./sec or faster.

7. A method for manufacturing a steel wire, the method comprising:

carrying out the method of claim 6; and subjecting the cold-workable mechanical structural steel obtain, to at least one process of annealing, spheroidizing annealing, wire drawing, heading, or quenching-and-tempering.

8. The steel of claim 1, wherein the steel comprises the bainite.

9. The steel of claim 1, wherein the steel comprises the martensite.

10. The steel of claim 1, wherein the steel comprises the pearlite.

11. The steel of claim 1, wherein the steel comprises the bainite and the martensite.

12. The steel of claim 1, wherein the steel comprises the bainite and the pearlite.

13. The steel of claim 1, wherein the steel comprises the martensite and the pearlite.

14. The steel of claim 1, wherein the steel comprises the bainite, the martensite, and the pearlite.

15. The steel of claim 1, further comprising:

(A) Cu in a range of from greater than 0 to 0.25 mass %, Ni in a range of from greater than 0 to 0.25 mass %, and/or Mo in a range of from greater than 0 to 0.40 mass %.

16. The steel of claim 1, further comprising:

(B) Ti in a range of from greater than 0 to 0.20 mass %, Nb in a range of from greater than 0 to 0.20 mass %, and/or V in a range of from greater than 0 to 1.50 mass %.

17. The steel of claim 1, further comprising:

(C) N in a range of from greater than 0 to 0.01 mass %, Mg in a range of from greater than 0 to 0.02 mass %, Ca in a range of from greater than 0 to 0.05 mass %, Li in a range of from greater than 0 to 0.02 mass %, and/or REM in a range of from greater than 0 to 0.05 mass %.

18. The steel of claim 1, having an area percentage of pro-eutectoid ferrite in a range of from 34 to 70%.

19. The steel of claim 1, having an area percentage of pro-eutectoid ferrite in a range of from 40 to 70%.

20. The steel of claim 1, wherein an average crystal grain size of pro-eutectoid ferrite in the steel is in a range of from 3.1 to 5.2 μm.

* * * * *